United States Patent [19]

Bartlett

[11] 4,196,552

[45] Apr. 8, 1980

[54] CRASH RAIL

[75] Inventor: Gary F. Bartlett, Muncy, Pa.

[73] Assignee: Construction Specialties, Inc., Cranford, N.J.

[21] Appl. No.: 949,882

[22] Filed: Oct. 10, 1978

[51] Int. Cl.[2] ..... E04F 19/02

[52] U.S. Cl. ..... 52/309.1; 52/718; 256/59; 248/345.1; 256/1

[58] Field of Search ..... 256/59, 65, 68, 69, 256/1; 248/345.1, 251; 52/718, 254, 309.1

[56] References Cited

U.S. PATENT DOCUMENTS

| | | | |
|---|---|---|---|
| 2,557,773 | 6/1951 | Steinman | 52/718 X |
| 3,270,474 | 9/1966 | Driggers | 52/718 X |
| 3,717,968 | 2/1973 | Olsen | 52/718 X |
| 3,825,229 | 7/1974 | Bartlett | 256/59 |
| 3,861,110 | 1/1975 | Bartlett | 52/718 |
| 3,991,537 | 11/1976 | Brown | 248/341.1 X |
| 4,104,839 | 8/1978 | Balzer | 52/254 |

*Primary Examiner*—Andrew V. Kundrat
*Attorney, Agent, or Firm*—Brumbaugh, Graves, Donohue & Raymond

[57] ABSTRACT

A crash rail for mounting on a wall or the like to absorb impacts comprises mounting clips fastened at intervals to the wall, an elongated crash member of a resilient, impact-resistant polymeric material fastened to the clips, and an elongated structural back-up member mounted on the clips between the front wall of the crash member and the wall. A longitudinally continuous impact cushion is interposed between the structural back-up member and the inner face of the front wall of the crash member and permits deformation of the front wall of the crash member, but limits the degree of such deformation, and absorbs part of the energy of an impact to the crash member.

5 Claims, 2 Drawing Figures

CRASH RAIL

BACKGROUND OF THE INVENTION

It is common practice to provide protection for walls and window areas in the corridors and other high traffic public and service spaces, such as kitchens, laundries, file and mail rooms, and cafeterias, of commercial manufacturing and health care facilities against impact from carts and equipment, and a variety of bumper rails, crash or trolley rails and hand rails specifically designed to provide protection is available and in widespread use. The assignee of the present invention has for some time marketed a line of wall protection products under its trademark ACROVYN, such products including hand rails and wall bumper guards constructed in accordance with U.S. Pat. Nos. 3,717,968 and 3,825,229 which consist of longitudinally continuous metal structural members and bumper members coextensive with the structural members and made of a resilient impact-resistant polymeric material (plastic), such as a mixture of vinyl and acrylic polymers. The plastic impact members have provided outstanding performance in resisting marring and breakage and in protecting the wall surfaces on which they are mounted, and the fact that they can be made in a variety of colors makes them very popular with architects and designers for aesthetic reasons as well as for their ability to retain their original, like-new appearance for many years with a minimum of maintenance.

The hand rails and bumper guards are generally entirely effective when there is reasonable assurance that impacts will occur at a relatively limited vertical zone at the height at which the hand rails and bumper guards are installed. On the other hand, there are occasions when the nature of the equipment rolled or carried through corridors or other areas where wall protection is provided may impact at various heights over a wider range than the two to four inches for which bumper guards and hand rails provide protection. Moreover, cost considerations may lead the building owner to choose a simpler wall protection device, such as a so-called crash rail or trolley rail.

One form of commercially available crash or trolley rail consists of a series of relatively narrow metal clips rigidly fastened to the wall and a generally U-shaped plastic impact member snapped onto the clips. The front face of the crash member is substantially flat and has a height of several inches, typically eight inches, thus providing protection against impacts over a fairly wide range of heights. The mounting flanges by which the impact member is attached to the clips provide a stand-off distance of about one inch, and spacers can be provided to increase the stand-off distance, if desired. The space between the front face of the crash member and the wall is entirely open which means that the front face is subject to deformation upon impact, and that deformation may be sufficiently large to dislodge one of the retainer flanges from the clips, thus resulting in partial or full dislodgement of the crash rail from the mounting clips.

SUMMARY OF THE INVENTION

There is provided, in accordance with the invention, an improvement in a crash rail of the typed described above, namely one consisting of a continuous, impact-resistant crash member mounted on a series of clips fastened to the wall at intervals. In particular, the improvement involves the addition of a structural back-up member mounted on the clips and longitudinally coextensive with the crash member and at least one longitudinally continuous resilient impact cushion member mounted on the back-up member and in engagement with the back face of the front wall of the crash member. The structural back-up member and the impact cushion permit deformation of the front wall of the crash member but limit the degree of such deformation to an amount less than that sufficient to disengage the edge flanges from retention by the clips. Moreover, the cushion member absorbs a portion of the energy of an impact to the front face of the crash member, thus enhancing the ability of the crash rail to absorb an impact, particularly by spreading any concentrated impact force over a greater distance along the length of the crash member.

In a preferred embodiment, according to the invention, the structural back-up member is of uniform cross section along its length and includes, in cross section, a web portion, preferably of a width approximately equal to the width of the cushion member, and a pair of mounting legs which diverge rearwardly and outwardly from the web portion toward the mounting clips. The ends of the legs and the front faces of the clips have interengaging tongue and groove formations constructed so that the structural member is merely snapped into place and is resiliently retained in place on the clips by a resilient pre-load force on the legs, the legs being initially formed with an included angle between them that is slightly greater than the angle between them when the structural member is in place on the clips so that they are resiliently deformed upon installation. The foregoing geometry, notably the diverging legs, ensures that the structural member will remain in place on the clips, in that forces due to impact transmitted through the legs toward the wall are transmitted with a force component that is parallel to the wall and outwardly from the axis of the clips, thus preventing disengagement of the back-up member from the clips. The configuration of the structural back-up member also involves the use of a minimum amount of material, thus keeping costs low.

Each of the clips of a preferred embodiment has a retainer flange at each end which engages a corresponding retainer flange on the crash member, and each flange on the clip has a camming surface that faces generally away from the wall and from the axis of the clips and is engageable by the free edge of the corresponding flange of the crash member and forces the crash member flange to deflect outwardly relative to the axis of the clips when the bumper member is pushed toward the wall upon installation, thereby facilitating installation. A preferred embodiment of the crash rail also has an improved end assembly which includes a bracket having a web portion, lying perpendicular to the wall, one leg that is secured flat against the wall in a position underlying the end portion of the bumper member and another leg that extends substantially parallel to and under the end of the front wall of the crash member and engages the front wall to prevent deflection of the end of the crash member upon impact. An end piece is fastened to the bracket by fasteners extending through the web portion and into the end piece in a direction away from the crash member.

For a better understanding of the invention, reference may be made to the following description of an exemplary embodiment, taken in conjunction with the accompanying drawing.

DESCRIPTION OF EXEMPLARY EMBODIMENT

Figure 1:
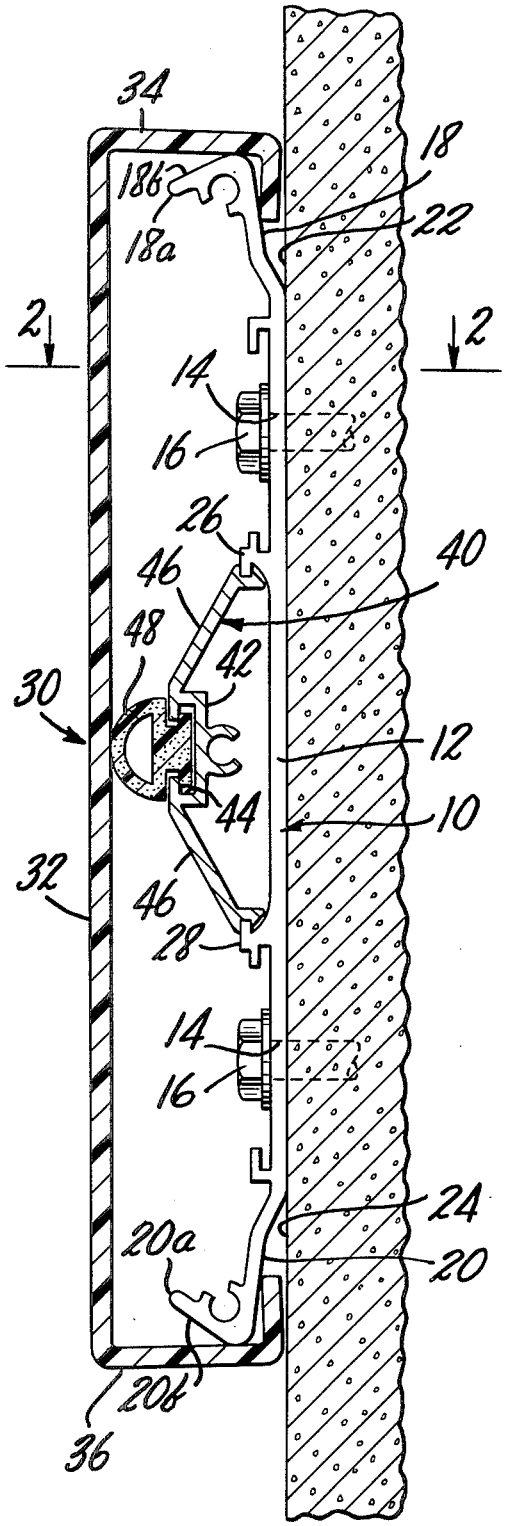
FIG. 1 is an end view in cross section of a crash rail installed on a wall.

The crash rail comprises, first of all, a series of relatively narrow clips 10, each of which has a vertically elongated, flat base portion 12 that lies flat against the wall and is provided with holes 14 to receive fasteners 16 for securely fastening it to the wall, preferably directly to studs or other structural components of the wall (not shown). Each clip further includes upper and lower flanges 18 and 20 which are offset outwardly from the base portion 12 to define with the wall recesses or slots 22 and 24. Each of the flanges 18 and 20 is generally L-shaped in cross section and has an outwardly extending leg portion 18*a* and 20*a*, respectively, that lies oblique to the wall and presents a camming surface 18*b* and 20*b*, respectively, the purpose of which is described in more detail below. Small L-shaped flanges 26 and 28 extend from the front face of each clip 10. The clips are preferably made by cutting pieces to the desired width from a continuous aluminum extrusion; relatively narrow clips, say two inches wide, are used at all locations other than at splices where two lengths of crash member meet end to end, in which case longer clips of identical cross section are used, say clips four inches wide.

The crash member 30 is a member of uniform cross section along its length having a substantially flat front wall portion 32 and an L-shaped flange 34, 36 extending perpendicularly from each end of the front wall portion 32. The crash member 30 is preferably made of a resilient, impact-resistant plastic, such as a vinyl-acrylic copolymer, by extrusion. The longer leg of each retainer flange 34, 36 as the crash member is extruded (i.e., when not installed on the clips) lies at an angle to the front wall portion 32 that is slightly less than the angle that it makes with the wall portion when the crash member is installed, thus to provide when installed a slight deformation of the retainer flanges outwardly relative to the axis of the clips, and resulting resilient pre-load forces in the flanges that hold the crash member tightly on the clips. The shorter free-end leg of each L-shaped retainer flange 34, 36, is received within a corresponding slot 20, 22 at the respective end of each of the clips.

The crash member is installed on the clips by pushing one of the retainer flanges into place along the clips and then pressing the other retainer flange toward the wall; this will cause the free end of the as yet unseated retainer flange to engage the corresponding camming surface (18*b* or 20*b*) of the flanges on the clips 10; upon pushing that as yet unseated retainer flange toward the wall, the camming surface 18*b* or 20*b* on each of the flanges of the clips force that retainer flange on the crash member to deform outwardly relative to the axis of the clips until it clears the outermost extremity of the clip flanges, whereupon it will snap into the slots 22 or 24 behind the clip flanges. It is up to the installer whether he desires to fit the bottom or the top edge in place first. Installation involves starting near one end of each crash member section and progressively pressing the then unseated flange into place in the manner described. Once the free end of the unseated retainer flange of the crash member clears the extremity of the retainer flange of a given clip, the inherent resiliency of the crash member will cause the flange to pull itself progressively into final position as the installer works farther along the length of the crash rail.

A structural back-up member 40 extends continuously along the length of the crash rail, except for short parts near the terminal ends of a continuous rail installation, as described below. The back-up member 40, which is preferably an aluminum extrusion, comprises, in cross-section, a web portion 42 having an undercut recess or groove 44 that opens outwardly toward the back face of the front wall 32 of the crash member 30 and legs 46 that diverge outwardly and rearwardly from the web portion 42. Each leg has a bead at its free end, and a slot in each bead receives a rib on an L-shaped flange 26 or 28 on the clip 10. The extremities of the beads are shaped to provide a camming action such that the back-up member will snap into place by pushing it toward the clips. The internal or included angle between the legs 46 of the back-up member 40, as the member 40 is initially formed (when it is not installed on the clips), is slightly greater than the final angle as installed so that when the back-up member is in place on the clips, the legs 46 provide a resilient pre-load force which retains the back-up member on the clips. Moreover, the divergence or spread of the legs from the web portion 42 ensures that forces transmitted by the legs to the clips have a component acting away from the axis of the clips and parallel to the wall. A longitudinally continuous resilient cushion member 48 is received in the slot 44 in the back-up member 40.

In a typical installation (FIG. 2) lengths of the crash rail terminate at inside (not shown) and outside corners as well as at free terminations at doorways, branch corridors and the like. The crash rail employs a universal end piece which is used interchangeably at both outside corners and end terminations. More particularly, each end piece 50 is a member that is preferably made of the same plastic as the crash member by either casting or injection molding. The outer surface of the end piece is a surface defined by profile line matching the external cross sectional profile of the crash member rotated about an axis substantially at the intersection of the wall with a perpendicular end plane at the termination of the crash rail. Internal bosses 52 and ribs 54 and 56 impart strength to the end piece and, preferably, have holes to receive self-tapping screws 58 by which the end pieces are mounted on end brackets 60 at end terminations of the crash rail or corner brackets 62 at an outside corner. Each end bracket 60 includes in cross-section a longer leg 64 which lies flat against and is securely fastened to the wall, a web portion #66 lying perpendicular to the leg 64, and a shorter leg 68 which underlies and engages the end of the front wall 32 of the crash member, thus preventing the end part of the front wall of the crash member from being deformed upon impact and preventing the possibility of the end piece being impacted from the direction of the crash member. The bracket 60 is preferably made by cutting pieces to a length slightly less than the height of the crash member from a continuous aluminum extrusion, the bracket 60 being shown in cross section perpendicular to the axis of the extrusion in FIG. 2.

Figure 2:
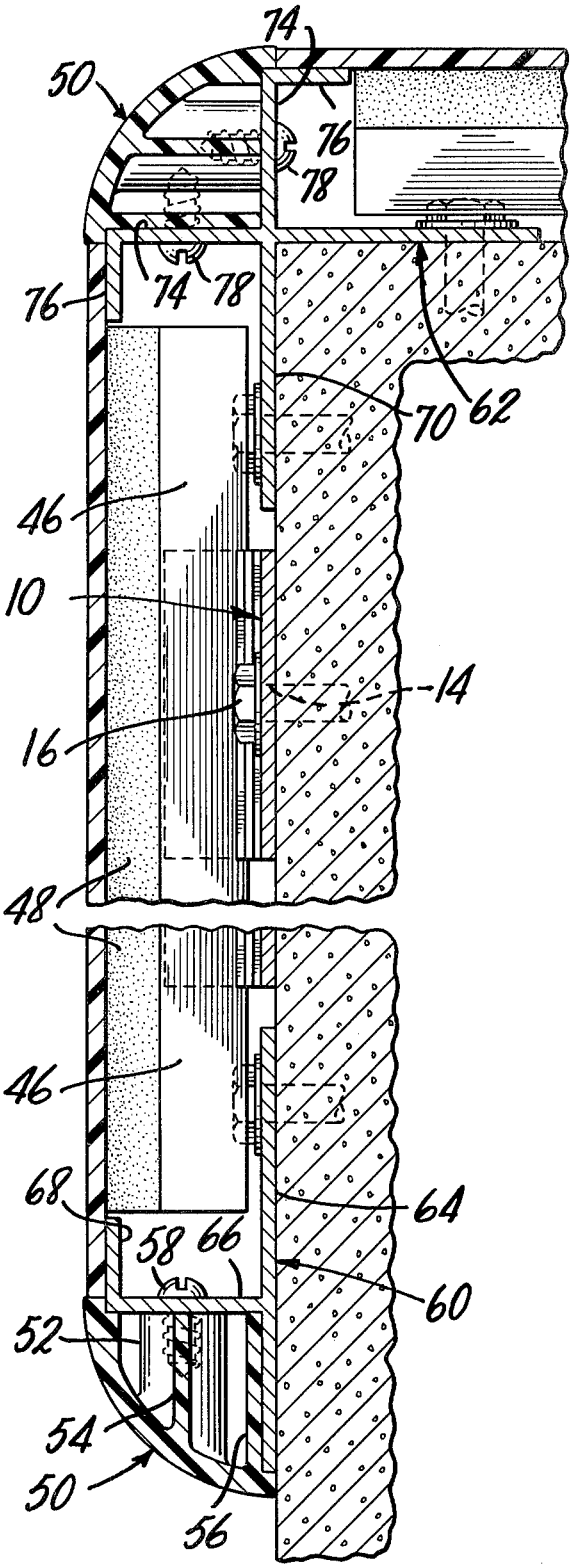
FIG. 2 is a top cross-sectional view of the crash rail in a typical installation, the section being taken generally along a plane represented by the lines 2—2 and in the direction of the arrows in FIG. 1 with portions broken away.

The special corner bracket 62 for an outside corner, which is also preferably an aluminum extrusion cut to length and is shown in FIG. 2 in cross section perpendicular to the axis of the extrusion, is generally X-shaped and includes a generally L-shaped base portion 70 having legs intersecting at right angles and securely fastened to the wall at the corner and a pair of L-shaped mounting flanges 74. The shorter legs 76 underlie and engage the end portion of the front wall 32 of the crash member, again to prevent the end of the crash member from deflecting and exposing part of the end piece to impact from the direction of the rail. The universal end piece 50 is attached to the bracket 62 by screws 78 extending from the direction of the rail through the two mounting flanges 74 and into the bosses 52. An inside corner may be finished in the same way as an end by providing a universal end piece at the termination of each rail section meeting at the inside corner, or the two sections can be finished at a butt joint without end pieces 50.

Among the advantages of the crash rail, according to the present invention, is ease of installation. The cushion members 48 are slided endwise into the back-up member 40, which can be either a field or a factory operation. The various clips and brackets are first installed, a task which may be facilitated by preassembling the required brackets on to the back-up member 40 to ensure accurate alignment of the clips; as described above, the back-up member is assembled to the clips by merely snapping the back-up member into place. The termination brackets 60 and/or 62 are installed, with the universal end pieces pre-attached on them, and as the final step the crash members are pushed into place on the clips.

The resiliency of the cushion member 48 and the clearance between the outer face of the web portion 42 of the back-up member and the crash member 30 are such as to permit substantial deformation of the front wall 32 of the crash member toward the wall upon impact. At the same time, however, the amount of deformation is limited to that permitted by the compressibility of the cushion member, and in all cases the amount of such deformation is such as to preclude dislodgement of the retainer flanges 34 or 36 of the crash member 30 from the capturing recesses 22 or 24 defined between the wall and the retainer flanges 18 and 20 of the clips. Even in the unlikely event of an impact having a substantial vertical force component, the crash member 30 will remain engaged on the clips. An aspect of the construction of the crash rail that provides firm retention of the crash member on the clips is the provision of return flange portions of substantial length in cross section that extend into the recesses 22 and 24 defined by each clip flange. The back-up member 40 and the cushion 48 also share with the bumper member 30 the impact forces imposed on the crash rail, particularly insofar as the back-up member 40 and cushion 48 spread the forces of a concentrated impact over a substantial length of the crash rail; thus the durability of the crash rail, in accordance with the present invention, is considerably enhanced as compared to crash rails that do not have a continuous structural back-up member.

I claim:

1. In a crash rail for mounting on a wall or the like to absorb impacts of objects that might otherwise hit and damage or mar the wall and including a multiplicity of mounting clips rigidly fastened to the wall at spaced-apart locations along a common axis and an elongated crash member of a resilient impact-resistant polymeric material, the crash member being of uniform cross section along its length and having in cross-section a substantially flat front wall portion and a pair of spaced-apart retainer flanges extending rearwardly from the front wall and engaging the clips and retaining the crash member on the clips, the improvement comprising an elongated structural back-up member mounted on the clips intermediate the retainer flanges of the crash member in alignment with the said axis and extending substantially coextensively with the crash member and outwardly from the clips toward the front wall of the crash member, the forwardmost extremity of the back-up member being spaced from the front wall of the crash member, and at least one longitudinally continuous resilient impact cushion member mounted on the back-up member in engagement with the back face of the front wall of the crash rail intermediate the retainer flanges, the cushion member being substantially coextensive with the back-up member and permitting deformation of the front wall of the crash member, but limiting the degree of such deformation to a magnitude less than that sufficient to disengage the retainer flanges from retention by the clips, and absorbing a portion of the energy of an impact to the outer face of the front wall of the crash member.

2. A crash rail according to claim 1 wherein the structural back-up member is of uniform cross-section along its length and includes in cross-section a web portion on which the cushion member is mounted and a pair of mounting legs extending from the web portion, the mounting legs being resiliently deformable, and further comprising inter-engaging tongue and groove formations on each of the clips and on each leg of the structural member retaining the legs resiliently deformed to engage the clips with a pre-load retaining force.

3. A crash rail according to claim 2 wherein the legs of the back-up member diverge from each other in a direction away from the web portion such that an impact force toward the wall imparted to the web portion is transmitted to the clips with a component which augments the resilient pre-load retaining force engaging the tongue and groove formations.

4. A crash rail according to claim 1 wherein each clip includes retainer flanges engaged by the respective retainer flanges of the crash member, at least one such retainer flange on each clip having a camming surface facing generally away from the wall and engageable by the free edge of the corresponding flange of the crash member for forcing the crash member flange to deflect outwardly relative to the axis of the clips when the crash member is pushed toward the wall upon installation, thereby to facilitate installation.

5. A crash rail according to claim 1 and further comprising an end assembly including a bracket having a web portion, a first leg portion joined to the web portion and adapted to be secured to the wall in a position underlying the end portion of the crash member and a second leg portion joined to the web portion and extending substantially parallel to and under the end of the front wall of the crash member in engagement therewith to restrict deflection of the end of the crash member toward the wall, and an end piece fastened to the bracket by fasteners extending through the web portion of the bracket and into the end piece in a direction away from the end of the crash member.

* * * * *